United States Patent [19]

Cherney

[11] 3,992,314

[45] Nov. 16, 1976

[54] PROCESS FOR THE PREPARATION OF SPRAY-DRIED CALCIUM CARBONATE-CONTAINING GRANULES

[75] Inventor: Steven D. Cherney, Springdale, Ohio

[73] Assignee: The Procter & Gamble Company, Cincinnati, Ohio

[22] Filed: Sept. 27, 1974

[21] Appl. No.: 509,863

[52] U.S. Cl. ..... 252/160; 252/DIG. 15; 252/175; 252/531; 252/532; 252/539

[51] Int. Cl.[2] ..... C11D 7/12

[58] Field of Search ..... 252/160, 175, 531, 532, 252/539, DIG. 15

[56] References Cited

UNITED STATES PATENTS 3,843,563 10/1974 Davis et al. ..... 252/547

FOREIGN PATENTS OR APPLICATIONS 798,856 10/1973 Belgium 735,668 8/1973 South Africa

*Primary Examiner*—Mayer Weinblatt

*Attorney, Agent, or Firm*—Forrest L. Collins; Charles A. Wilson; Robert B. Aylor

[57] ABSTRACT

A method is provided for the preparation of a granular calcium carbonate-containing mixture wherein the calcium carbonate particles have a high effective surface area and a low degree of agglomeration.

14 Claims, No Drawings

PROCESS FOR THE PREPARATION OF SPRAY-DRIED CALCIUM CARBONATE-CONTAINING GRANULES

BACKGROUND OF THE INVENTION

1. Field of the Invention

This invention relates to spray drying a calcium carbonate-containing slurry into a granular matrix such that the ultrafine calcium carbonate particles maintain a high effective surface area and exhibit low agglomeration. Calcium carbonate-containing granules formed in the present invention may be used in the concurrently filed U.S. Application Ser. No. 509,866, filed Sept. 27, 1974 entitled BUILDER SYSTEM AND DETERGENT PRODUCT to Richard W. Benson, Steven D. Cherney, and Everett T. Collier, or in the detergent composition disclosed in Belgian Patent No. 798,856 to Jacobsen et al. both of which are herein incorporated by reference.

2. Description of the Prior Art Practices

This invention relates to the preparation of a spray-dried calcium carbonate-containing granule wherein the calcium carbonate particles within the granule retain a substantially discrete form and substantially the same surface area as the calcium carbonate particles had in the slurry before spray drying.

It is known that finely divided or microcrystalline calcium carbonate particles may be used as a crystallization seed in combination with a precipitating builder to accelerate the removal of soluble calcium ions from wash water. The term "soluble calcium ions" includes not only divalent calcium ions but also calcium salts which have associated but have not precipitated, for instance, singular calcium carbonate molecules. The associated forms of soluble calcium such as the monomolecular calcium carbonate exist in rapid equilibrium with calcium ions and carbonate ions such that depletion of both the free calcium ions and the other soluble associated calcium species is necessary.

Crystallization seeds such as those employed in the present invention are believed to function by providing growth sites for the precipitating free calcium ions and other soluble calcium species. The number of crystallization seeds present per unit weight and the surface area of each particle determines the total surface area present per unit weight. The number of growth sites upon which soluble calcium may precipitate appears to be directly proportional to the total surface area of the crystallization seed. The problem not previously solved is to economically incorporate the ultrafine or microcrystalline calcium carbonate particles into a granular detergent composition such that the particles are maintained in their discrete or nonagglomerated high effective surface area form thereby requiring a minimal amount of calcium carbonate. The term "effective surface area" indicates a measurement of the surface area available for crystal growth which is area available to precipitate soluble calcium onto a given weight of calcium carbonate crystallization seeds. The term "nominal surface area" indicates the total surface area of a given weight of calcium carbonate crystallization seed without regard to the effectiveness in soluble calcium depletion. To provide favorable kinetics for soluble calcium removal from a wash water solution, it is desirable that the calcium carbonate crystallization seeds have a high effective surface area per unit weight and a large number of particles.

Several methods are known in the art for the preparation of calcium carbonate particles which in slurry form exhibit high surface areas and particle diameters within the range desirable for incorporation into laundry detergent compositions. The known methods for maintaining large numbers of discrete calcium carbonate particles of a high nominal surface area in a slurry include the addition to the aqueous slurry of a material such as sodium tripolyphosphate, sodium pyrophosphate, soluble silicates, and various anionic detergents. The problem with using the aforementioned materials to maintain a high nominal surface area and a large number of calcium carbonate particles is that the effective surface area is substantially reduced by the adsorption of the aforementioned salts and detergents onto the crystal surfaces. The apparent effect of, for example, polyphosphate ions is to bind to the lattice of the calcium carbonate crystallization seed to form a stable layer onto which the precipitation of the soluble calcium will not occur. The rendering of a crystallization seed ineffective with respect to the growth or nucleation sites such as by adsorption is known as poisoning.

The calcium carbonate crystallization seeds within an aqueus slurry when dried agglomerate resulting in a substantial loss of the number of discrete particles present as well as a reduction in the effective surface area of the calcium carbonate particles. However, the drying of a slurry of calcium carbonate particles while substantially reducing the effective surface area may in many instances reduce the nominal surface area only slightly. The phosphate salts, silicates, and anionic surfactants, which were previously mentioned as having the ability to maintain a large number of particles in a slurry do not in any case at the levels disclosed prevent the agglomeration of the calcium carbonate crystallization seed particles upon drying.

It is intended throughout the specification and claims that the term "agglomeration" or "agglomerate" is to embrace aggregate or composite which are more fully defined in U. S. Pat. No. 2,964,382 entitled PRODUCTION OF PRECIPITATED CALCIUM CARBONATE and issued to G. E. Hall on Dec. 13, 1960.

For the purposes of this invention, the effective surface area and the nominal surface area are equivalent for a given slurry of nonpoisoned, non-agglomerated calcium carbonate particles. It is intended throughout the specfication and claims that the terms free calcium ions, soluble calcium, and soluble calcium species, may be used interchangeably.

It has now been discovered that an aqueous slurry of discrete submicron high surface area calcium carbonate particles can be spray dried to give a calcium carbonate-containing granule wherein the calcium carbonate particle retains its high effective surface area and has a lessened tendency towards agglomeration or aggregation when an alkali metal carbonate, bicarbonate, or sesquicarbonate is included in the slurry.

As a result of practicing this invention, it is possible to spray dry a calcium carbonate-containing slurry to give a calcium carbonate-containing granule which will rapidly dissolve upon addition to a wash water solution and present a calcium carbonate crystallization seed of high effective surface area onto which soluble calcium ions in the wash solution may precipitate.

As was mentioned above, it is desirable that the calcium carbonate particles present in a wash solution exhibit a high effective surface area substantially equivalent to the nominal surface area of the calcium carbonate particles present in the slurry prior to spray drying. It will also be observed that by practicing the present invention that the tendency of the calcium carbonate particles to agglomerate during spray drying is substantially lessened as evidenced again by the calcium depletion rates of the non-dried slurry of calcium carbonate particles and the similar measurements made when the spray-dried calcium carbonate-containing granule is dissolved in a wash solution. Rapid soluble calcium depletion is necessary to prevent the soluble calcium from interfering with the detergent or depositing upon the fabric as calcium carbonate.

It has also been observed that previous attempts to use finely-divided or microcrystalline calcium carbonate particles in detergent compositions is objectionable because of the dust problems which can occur in handling calcium carbonate as a substantially dry material.

Another deficiency resulting from the incorporation of calcium carbonate crystallization seeds into detergent products is that the calcium carbonate particles during handling and shipping tend to segregate from the material with which they are admixed. It is further noted that when calcium carbonate crystallization seed particles are admixed directly into the granular detergent product that these particles when stored under conditions of high temperature and humidity have a tendency to cluster together to give a caked product.

It is an object of the present invention to prepare a calcium carbonate-containing granule from a calcium carbonate-containing aqueous slurry such that the discrete nature and the high effective surface area of the calcium carbonate particles in the slurry are substantially retained by the calcium carbonate particles within the spray-dried granule.

It is a further object of the present invention to prepare a calcium carbonate crystallization seed-containing granule which will rapidly dissolve when added to a wash solution such that the high surface area discrete calcium carbonate crystallization seed particles are rapidly available to induce the removal of soluble calcium ions from the wash solution.

It is yet a further object of the present invention to provide a method for the incorporation into a detergent product of submicron calcium carbonate crystallization seeds in the form of a much larger calcium carbonate-containing granule which substantially reduces the dust problems incurred in admixing dry submicron calcium carbonate particles.

Another object of the present invention is to provide a method for the incorporation into a detergent product of submicron calcium carbonate crystallization seeds such that the crystallization seeds do not cake together under conditions of high humidity and temperature.

It is yet another object of the present invention to provide a suitable carrier granule for certain detergent components such as soil suspension agents.

The benefits of the present invention are further described in the concurrently-filed, copending U.S. Application Ser. No. 509,864, filed Sept. 27, 1974, by Cherney, entitled SPRAY-DRIED CALCIUM CARBONATE-CONTAINING GRANULES herein incorporated by reference.

SUMMARY OF THE INVENTION

A process for the preparation of a calcium carbonate-containing granule wherein the calcium carbonate has a high effective surface area and low degree of agglomeration, comprising the steps of:

a. mixing a member selected from the group consisting of water-soluble alkali metal carbonates, bicarbonates, and sesquicarbonates and mixtures thereof, water, and submicron calcium carbonate particles wherein the weight ratio of the alkali metal salt to the calcium carbonate is from about 1:2 to about 7:5 to form an aqueous slurry; and b. spray drying the slurry of step (a) to form the calcium carbonate-containing granule.

Percentages and ratios throughout the specification and claims are by weight unless otherwise stated. Temperatures are in degrees Farenheit unless otherwise indicated.

DETAILED DESCRIPTION OF THE INVENTION

The present invention is carried out by forming an aqueous slurry comprising submicron calcium carbonate particles and a water-soluble salt selected from the group consisting of alkali metal carbonates, sesquicarbonates, and bicarbonates. The second step in carrying out the present invention is spray drying the aqueous slurry comprising the aforementioned water-soluble salt and the calcium carbonate crystallization seeds.

To be effective as a crystallization seed the calcium carbonate particle as was noted earlier, must be of a high effective surface area and further be present in a sufficient number of particles to ensure rapid depletion of the free calcium ions from a wash solution. The manner of determining the effectiveness of the crystallization seed will be discussed later.

To be effective as a crystallization seed, the calcium carbonate particle has a mean diameter less than one micron, preferably from about 0.01 to about 0.50 micron, more preferably from about 0.01 to about 0.25 micron, and most preferably the discrete calcium carbonate crystallization seed particle is from about 0.01 to about 0.10 micron in diameter.

The number of crystallization seed particles present per weight unit is affected by the agglomeration of the crystallization seed particles employed. The calcium carbonate particles may pack together tightly to form a composite such that fewer particles are present with a correspondingly smaller effective surface area to induce precipitation of the free calcium ions. This is to say that effective surface area of the calcium carbonate crystallization seed is partially determined by the extent of the agglomeration which has occurred between the calcium carbonate crystallization particles.

The crystallization seeds of the present invention vary in mean particle diameter from about 0.1 micron up to 1 micron. The mean diameter of the particle is the maximum dimension of a straight line passing through the center of the particle. Calcium carbonate crystallization seed particles ranging from about 0.2 micron and larger may be obtained commercially in dry form and slurred with water to an appropriate concentration before proceeding with the present invention. One commercially available form of calcium carbonate is marketed under the trade name PURECAL O which has mean individual calcium carbonate particles of approximately 0.25 micron in diameter. Preferably, however, the calcium carbonate particles used in the present invention are in the lower particle size ranges to ensure rapid free calcium depletion from the wash solution. Such fine particles can be manufactured by the process given in U. S. Pat. No. 2,981,596 entitled PREPARATION OF ALKALINE EARTH CARBONATES to Raymond R. McClure patented Apr. 25, 1961, herein incorporated by reference. The McClure process of the preparation of calcium carbonate utilizes calcium chloride and sodium carbonate which results in the formation of not only calcium carbonate but also sodium chloride. While some diluent salts such as sodium chloride or sodium sulfate may be present in the final spray-dried granule of the present invention, the benefits of using these salts is outweighed by the loss of formula room. Thus in the McClure process it is desirable to filter the solution after the calcium carbonate particles have been made such that the calcium carbonate is washed free of undesirable salts such as sodium chloride. Any convenient filtration apparatus may be used to concentrate the crystallization seeds.

The preferred calcium carbonate crystallization seed particle is calcite as opposed to the aragonite and vaterite crystal forms. Calcite is the preferred crystallization seed as it is the most stable form of calcium carbonate crystal.

As calcium carbonate in the desired particle size is usually prepared in an aqueous slurry it is preferred but not necessary that the calcium carbonate be dispersed in the slurry before the addition of the water-soluble salt.

The next step in the preparation of the calcium carbonate-containing granule is the addition to the slurry containing the calcium carbonate crystallization seeds of a water-soluble salt selected from the group consisting of the alkali metal carbonates, bicarbonates, and sesquicarbonates. Preferably the alkali metal is sodium, potassium, or lithium, most preferably sodium.

The effectiveness of the calcium carbonate crystallization seed depends not only on the choice of the precipitating builder employed, but also upon the respective concentrations in the wash solution. Thus, for instance, while sodium carbonate is perhaps the most desirable builder to be used in the present invention, larger amounts of sesquicarbonates may be used and thus build more effectively than a lesser amount of sodium carbonate.

Generally the weight ratio of the water-soluble salt to the submicron calcium carbonate particles in the calcium carbonate containing granule is from about 1:2 to about 75:1, preferably from about 1:1 to about 50:1, more preferably from about 3:2 to about 20:1, and most preferably from about 2:1 to about 10:1. The water-soluble salt may be added to the calcium carbonate slurry either dry or in solution preferably the former to minimize the amount of water which must be removed in the spray-drying operation. Within the ratios of the water-soluble salt to the calcium carbonate of the present invention, the amount of water present in the combined slurry ranges from about 20% to about 95%, preferably from about 30% to about 90%, and most preferably from about 40% to about 80% by weight.

The temperature of the combined slurry containing the water-soluble salt and the calcium carbonate is in the range of from about 50° F to about 250° F, preferably from about 80° F to about 190° F, and most preferably from about 90° F to about 120° F. It will be recognized that the slurry temperature may be adjusted for such factors as the solubility of the water-soluble salt, and the ease of carrying out the spray-drying operation from a heated slurry.

The formation of the calcium carbonate-containing granule is carried out using conventional detergent spray-drying apparatus. Basically a spray-drying operation involves the carrying of the slurry is introduced under pressure through a stream of drying gases. The drying gases employed for example include air or nitrogen.

The introduction of the slurry to the drying tower takes place through a series of atomizing nozzles at which point the material to be dried forms droplets. The droplets are then dried by the drying gas to form granules which are preferably hollow or puffed to provide rapid dissolution in the wash water. Without limitation to the present invention it is desirable but not necessary that the spray-dried calcium carbonate-containing granules are from about 0.1 to about 2 millimeters in diameter.

Preferably the slurry in the present invention contains only inorganic materials which allows the spray-drying operation to proceed with a temperature range the low side of which is effectively determined only by the desired rate of drying with the high temperature being determined by the temperature at which the salts present begin to decompose. If organic matter is present in the slurry temperature adjustments may be necessary to avoid charring. Thus the spray-drying operation may be carried out at temperatures of from about 200° F to about 1500° F, preferably from about 250° F to about 1200° F, and more preferably from about 300° F to about 800° F. The slurry may be spray dried in either a countercurrent or concurrent spray-drying tower. In a countercurrent spray-drying operation such as that described in U. S. Pat. No. 3,629,951, entitled MULTILEVEL SPRAY-DRYING METHOD issued to Robert P. Davis et al., Dec. 28, 1971, and herein incorporated by reference, the slurry of material to be spray dried is fed into the spray tower such that the flow of droplets is opposite to that of the drying gases. While the Davis et al. patent discloses a multilevel operation, a single-level arrangement of the atomizing nozzles is well within the scope of the present invention. Conveniently, however, the apparatus employed for spray drying may allow for the introduction of the slurry of the calcium carbonate particles and the water-soluble salt wherein the atomizing nozzles are placed closely to the source of the drying gas and the slurry is sprayed concurrently or in the same direction as the flow of the drying gas. The object of forming the calcium carbonate-containing granule such that it will be rapidly dissolved in a wash solution is best met by a granule which is concurrently spray dried to ensure that the granule is well puffed leaving the outer surface of the granule porous.

The Davis et al spray-drying method may be effectively utilized to incorporate the calcium carbonate-containing granule into a detergent product without the necessity of admixing a separate detergent base granule with the calcium carbonate-containing granule. The Davis et al. method may be modified such that the slurry containing the water-soluble salt and the calcium carbonate particles is introduced through nozzles placed near the source of the drying gas while the remainder of the detergent formulation is then fed through other atomizing nozzles positioned above the nozzles through which the calcium carbonate is introduced. In such a fashion it is possible to spray dry the calcium carbonate-containing granule as well as the detergent base granule in the same spray tower to form a substantially homogenized product of two distinct granule forms. The operation referred to above eliminates the necessity of storing large quantities of the base detergent granule or the calcium carbonate-containing granule. Organic detergents, for example, linear alkyl benzene sulfonates may be slurried with sodium sulfate or additional sodium carbonate in a weight ratio to the detergent of 10:1 to 1:10 to form the previously mentioned detergent granule.

The determination of the nominal surface area of the calcuim carbonate crystallization seed particle utilized in the present invention may be made by three techniques, namely, the Brunauer, Emmet, Teller (BET), dye adsorption, and the calcium depletion rate. In the BET method a dry sample of the material of which the surface area is to be determined is placed in a vial and exposed to nitrogen gas at liquifying temperatures. The surface area by BET is measured by the pressure differential caused by gas adsorbing onto the sample and calculated by assuming that the gas has formed at monolayers on the sample.

The dye adsorption technique for measuring surface areas is essentially similar to the BET method to the extent that the dyes employed adsorb in a simple monolayer onto the surface of the sample to be tested. The advantage of the dye adsorption method over the BET method is that the dye adsorption may be used in a slurry containing the material to be measured. Dye adsorption by measuring the surface area in a slurry avoids the loss of a substantial amount of surface area due to agglomeration during drying. The dye adsorption method provides a reliable manner of determining the nominal surface area of calcium carbonate particles in an aqueous slurry. The dye employed in determining the calcium carbonate surface area in solution is known as Alizerin Red and may be effectively used at concentrations of the dye at about 2–5 $\times 10^{-4}$M. The slurry may contain as much as 12% solids by weight. The sample slurry is mixed with a volume of dye and the amount of dye adsorbed is determined centrifuging the sample and measuring the absorbence of the supernatant. The amount of dye adsorbed is compared to dry samples run by BET with results reproducible at ±5%.

The method of determining the effective surface area of the calcium carbonate crystallization seed particles is that of measuring the soluble calcium depletion rate, from a wash solution. The effective surface area of the calcium carbonate crystallization seeds in a slurry is equal to the nominal surface area if the crystallization seeds are non-poisoned.

The calcium depletion rate is determined by filling a vessel with distilled water and then carefully adding water hardness which may be either calcium or calcium and magnesium preferably in a ratio of calcium to magnesium of 2:1 to approximate the water hardness in most areas of the United States. The overall hardness is added generally at 4, 7, or 11 grains per gallon as $CaC0_3$. The artificially hardened water may be maintained at any temperature, preferably at 80° to 120° F to approximate washing conditions. The calcium carbonate crystallization seeds and the water-soluble builder salt are added at approximately 0.01 to 0.12% by weight to the wash water. The alkali metal carbonate, bicarbonate, or sesquicarbonate in the calcium carbonate-containing granule may be augmented by adding additional amounts of the water-soluble builder salt to the wash water.

To determine the calcium depletion rate, samples of the wash solution are withdrawn at specified intervals after the crystallization seed and builder salt have been added and the sample is filtered through a suitable Millipore filter. The filtrate is then measured by atomic adsorption spectrophotometry to determine the amount of soluble calcium ion remaining in the system. It will be observed that the calcium carbonate in the calcium carbonate-containing granules formed by the present invention has substantially the same effective surface area as the calcium carbonate in the slurry.

It has been observed that the spray-dried calcium carbonate-containing granule of the present invention may serve as an excellent carrier granule for materials which do not lessen the effective crystallization seed surface area as previously defined. Materials such as soil suspension agents, namely polyethylene glycols, may be sprayed onto or incorporated in the calcium carbonate-containing granule to avoid processing the soil suspension agent with the remainder of the detergent composition.

The rate of soluble calcium depletion is subject to such conditions as the effective surface area of the calcium carbonate crystallization seeds, the number of particles present, the temperature of the wash solution and the pH thereof, and the concentration and type of the precipitating builder employed.

Generally the rate of depletion of free calcium ions increases as the temperature of a wash solution increases in a system using calcium carbonate crystallization seed particles. The most effective pH range with which the calcium carbonate crystallization seed particles may be employed with any given builder is generally from about 8 to about 12. It will be recognized at this point that the particular materials which were chosen as the water-soluble salt to be spray dried with the calcium carbonate particles are also known as detergency builders. The most effective of the materials chosen are the carbonate salts which when dissolved in water with the crystallization seed present will function as an effective builder without adjustment to the pH of the wash solution. The other salts spray dried with the calcium carbonate crystallization seed which are the soluble sesquicarbonates and soluble bicarbonates are also effective detergency builders, however, the use of large quantities of those builder salts may lower the pH of the wash solution to a point where the precipitation of calcium from the solution is somewhat inhibited. When using soluble sesquicarbonates or bicarbonates in the present invention, the pH can be adjusted by adding caustic or when the calcium carbonate-containing granule is admixed with a detergent product which can be formulated to the proper pH. The inclusion of sodium silicate in most detergent compositions is sufficient because of its high alkalinity to raise the pH to the point at which sodium sesquircarbonate and sodium bicarbonate are effective detergent builders.

It was previously noted that several materials most notably anionic surfactants and water-soluble salts of silicates and polyphosphates have the ability to substantially poison the surface area of a calcium carbonate crystallization seed. Therefore, to retain the highest effective surface area of the calcium carbonate crystallization seed, it is necessary that the aforementioned materials not come into contact with the aqueous calcium carbonate-containing slurry.

The following examples illustrate the present invention. Variations and modifications can be made in the examples without deviating from the practices taught and contemplated by the present invention.

EXAMPLE 1

Spray-dried calcium carbonate-containing granules are prepared by forming a slurry of calcium carbonate calcite particles having a mean diameter of about 0.02 micron and thoroughly mixing therewith sodium carbonate in a weight ratio of sodium carbonate to the calcium carbonate of 5:1. The combined slurry which is about 66% by weight water at 120° F is then pumped to a standard spray-drying unit and contacted with the drying gas which is introduced at about 550° F.

The calcium carbonate particle within the granule so formed retains substantially the same effective surface area and mean particle diameter as the calcium carbonate particles in the slurry. The granule itself is highly puffed or porous allowing for rapid dissolution in the wash water. The puffed granule reduces plant dust problems significantly while segregation and caking are markedly retarded when compared to admixing dry calcium carbonate particles.

Substantially similar results as those obtained above are enjoyed when vaterite or aragonite crystallization seed crystals are employed.

EXAMPLE II

Spray-dried calcium carbonate-containing granules are prepared by forming a slurry of calcium carbonate calcite particles having a mean diameter of about 0.02 micron and thoroughly admixing therewith sodium carbonate in a weight ratio of sodium carbonate to the calcium carbonate of 3:1. The combined slurry which is about 64% by weight water at 100° F is then pumped to a standard spray-drying unit and contacted with the drying gas which is introduced at about 550° F.

The calcium carbonate particle within the granule so formed retains substantially the same effective surface area and mean particle diameter as the calcium carbonate particles in the slurry. The granule itself is highly puffed or porous allowing for rapid dissolution in the wash water. The puffed granule reduces plant dust problems significantly while segregation and caking are markedly retarded when compared to admixing dry calcium carbonate particles.

Substantially similar results are obtained when the aqueous slurry is 78% by weight water and the slurry temperature is 120° F.

EXAMPLE III

Spray-dried calcium carbonate-containing granules are prepared by forming a slurry of calcium carbonate calcite particles having a mean diameter of about 0.25 micron and thoroughly mixing therewith sodium bicarbonate in a weight ratio of sodium bicarbonate to the calcium carbonate of 4:1. The combined slurry which is about 30% by weight water at 150° F is then pumped to a standard spray-drying unit and contacted with the drying gas which is introduced at about 400° F.

The calcium carbonate particle within the granule so formed retains substantially the same effective surface area and mean particle diameter as the calcium carbonate particles in the slurry. The granule itself is highly puffed or porous allowing for rapid dissolution in the wash water. The puffed granule reduces plant dust problems significantly while segregation and caking are markedly retarded when compared to admixing dry calcium carbonate particles.

Substantially similar results are obtained when the drying gas is introduced at 450° F, 500° F, and 600° F.

EXAMPLE IV

Spray-dried calcium carbonate-containing granules are prepared by forming a slurry of calcium carbonate calcite particles having a mean diameter of about 0.01 micron and thoroughly mixing therewith sodium carbonate in a weight ratio of sodium carbonate to the calcium carbonate of 3:1. The combined slurry which is about 60% by weight water at 120° F is then pumped to a standard spray-drying unit and contacted with the drying gas which is introduced at about 600° F.

The calcium carbonate particle within the granule so formed retains substantially the same effective surface area and mean particle diameter as the calcium carbonate particles in the slurry. The granule itself is highly puffed or porous allowing for rapid dissolution in the wash water. The puffed granule reduces plant dust problems significantly while segregation and caking are markedly retarded when compared to admixing dry calcium carbonate particles.

Substantially similar results are obtained where the water-soluble salt is potassium carbonate in a weight ratio to the calcium carbonate of 2:1, or potassium bicarbonate in a weight ratio to the calcium carbonate of 3:1.

EXAMPLE V

Spray-dried calcium carbonate-containing granules are prepared by forming a slurry of calcium carbonate calcite particles having a mean diameter of about 0.025 micron and thoroughly mixing therewith sodium carbonate in a weight ratio of sodium carbonate to the calcium carbonate of 5:1. The combined slurry which is about 78% by weight water at 100° F is pumped to a standard spray-drying unit and contacted with the drying gas which is introduced at about 700° F.

The calcium carbonate particle within the granule so formed retains substantially the same effective surface area and mean particle diameter as the calcium carbonate particles in the slurry. The granule itself is highly puffed or porous allowing for rapid dissolution in the wash water. The puffed granule reduces plant dust problems significantly while segregation and caking are markedly retarded when compared to admixing dry calcium carbonate particles.

To demonstrate the benefits of spray drying the crystallization seeds in the presence of a water-soluble builder salt, the calcium depletion rates for the granule (A) formed in accordance with the above example are compared to crystallization seeds spray dried in the absence of the water-soluble builder. When the crystallization seeds are spray dried separately (B), the builder is dry mixed with the seeds. The dry samples in the test are preslurried to minimize the effect of dispersion of the granule. For purposes of cross-comparison, the test includes the slurry of calcium carbonate with the water-soluble builder present added directly to the water without being spray dried (C).

All tests are run at 0.006% by weight calcium carbonate crystallization seeds and 0.03% by weight sodium carbonate.

The results are compared in Table 1.

TABLE 1

| Soluble Calcium (grains per gallon as $CaCO_3$) | | | |
|---|---|---|---|
| TIME | A SPRAY-DRIED $CaCO_3$ CONTAINING GRANULE | B $CaCO_3$ SPRAY-DRIED ALONE WITH $Na_2CO_3$ ADMIXED | C $CaCO_3$ AND BUILDER SLURRY NOT SPRAY-DRIED |
| 0 | 7.6 | 7.5 | 7.7 |
| 30 seconds | 3.2 | 5.9 | 2.9 |
| 1 minute | 2.2 | 4.9 | 2.1 |
| 90 seconds | 1.7 | 3.8 | 1.7 |
| 2 minutes | 1.7 | 3.4 | 1.6 |
| 3 minutes | 1.4 | 2.8 | 1.4 |
| 5 minutes | 1.2 | 2.1 | 1.2 |
| 8 minutes | 1.1 | 1.7 | 1.2 |
| 10 minutes | 1.0 | 1.5 | 1.1 |

The initial water hardness in the wash solution is about 12 grains/gallon of calcium and magnesium ions in a 2:1 ratio. The temperature throughout the test is maintained at 100° F. The soluble calcium levels are determined by atomic absorption spectrophotometry as is previously described. The results show that the calcium carbonate-containing granules prepared by the present invention have an effective calcium carbonate surface and substantially equivalent to the non-dried calcium carbonate particles in the slurry.

sion of the granule. For purposes of cross-examination, the test includes the slurry of calcium carbonate with the water-soluble builder present added directly to the wash water without being spray dried (C).

All tests are run with the calcium carbonate crystallization seeds in water at 0.006% by weight while the sodium carbonate is present at 0.03% by weight. In test A, the granule is supplemented with additional sodium carbonate up to the 0.03% level.

The results are compared in Table 2.

TABLE 2

| Soluble Calcium (grains per gallon as $CaCO_3$) | | | |
|---|---|---|---|
| TIME | A SPRAY-DRIED $CaCO_3$ CONTAINING GRANULE | B $CaCO_3$ SPRAY-DRIED ALONE WITH $Na_2CO_3$ ADMIXED | C $CaCO_3$ AND BUILDER SLURRY NOT SPRAY-DRIED |
| 0 | 7.9 | 7.5 | 7.7 |
| 30 seconds | 4.3 | 5.9 | 2.9 |
| 1 minute | 3.3 | 4.9 | 2.1 |
| 90 seconds | 2.5 | 3.8 | 1.7 |
| 2 minutes | 2.1 | 3.4 | 1.6 |
| 3 minutes | 1.8 | 2.8 | 1.4 |
| 5 minutes | 1.5 | 2.1 | 1.2 |
| 8 minutes | 1.2 | 1.7 | 1.2 |
| 10 minutes | 1.1 | 1.5 | 1.1 |

EXAMPLE VI

Spray-dried calcium-containing granules are prepared by forming a slurry of calcuim carbonate calcite particles having a mean diameter of about 0.025 micron and thoroughly mixing therewith sodium carbonate in a weight ratio of sodium carbonate to the calcium carbonate of 1:1. The combined slurry which is about 78% by weight water at 100° F is then pumped to a standard spray-drying unit and contacted with the drying gas which is introduced at about 700° F.

The calcium carbonate particle within the granule so formed retains substantially the same effective surface area and mean particle diameter as in the calcium carbonate particles in the slurry. The granule itself is highly puffed or porous allowing for rapid dissolution in the wash water. The puffed granule reduces plant dust problems significantly while segregation and caking are marked retarded when compared to admixing dry calcium carbonate particles.

To demonstrate the benefits of spray drying the crystallization seeds in the presence of a water-soluble builder salt the calcium depletion rates for the granule (A) formed in accordance with the above example are compared to crystallization seeds spray dried in the absence of the water-soluble builder. When the crystallization seeds are spray dried separately (B), the builder is dry mixed with the seeds. The dry samples in the test are preslurried to minimize the effect of disper- The initial water hardness in the wash solution is about 12 grains/gallon of calcium and magnesium ions in a ratio of 2:1. The temperature throughout the test is maintained at 100° F. The calcium depletion rates are determined by atomic absorption spectrophotometry as is previously described. The results show that the claim carbonate-containing granules prepared by the present invention have an effective calcium carbonate surface area substantially equivalent to the non- dried calcium carbonate particles in the slurry.

EXAMPLE VII

Spray-dried calcium carbonate-containing granules are prepared by forming a slurry of calcium carbonate calcite particles having a mean diameter of about 0.025 micron and thoroughly mixing therewith sodium carbonate in a weight ratio of sodium carbonate to the calcium carbonate of 3:1. The combined slurry which is about 78% by weight water at 100° F is then pumped to a standard spray-drying unit and contacted with the drying gas which is introduced at about 700° F.

The calcium carbonate particle within the granule so formed retains substantially the same effective surface area and mean particle diameter as the calcium carbonate particles in the slurry. The granule itself is highly puffed or porous allowing for rapid dissolution in the wash water. The puffed granule reduces plant dust problems significantly while segregation and caking are markedly retarded when compared to admixing dry calcium carbonate particles.

To demonstrate the benefits of spray drying the crystallization seeds in the presence of a water-soluble builder salt the calcium depletion rates for the granule (A) formed in accordance with the above example are compared to crystallization seeds spray dried in the absence of the water-soluble builder. When the crystallization seeds are spray dried separately (B), the builder is dry mixed with the seeds. The dry samples in the tests are preslurried to minimize the effect of dispersion of the granule. For purposes of cross-comparison, the test includes the slurry of calcium carbonate with the water-soluble builder present added directly to the wash water without being spray dried (C).

The calcium carbonate crystallization seeds are present in the wash water at 0.006% by weight, while the sodium carbonate is present at 0.03% by weight. In test A, the granule is supplemented with additional sodium carbonate up to the 0.03% level.

The results are compared in Table 3.

TABLE 3

| | Soluble Calcium (grains per gallon as $CaCO_3$) | | |
|---|---|---|---|
| TIME | A SPRAY-DRIED $CaCO_3$ CONTAINING GRANULE | B $CaCO_3$ SPRAY-DRIED ALONE WITH $Na_2CO_3$ ADMIXED | C $CaCO_3$ AND BUILDER SLURRY NOT SPRAY-DRIED |
| 0 | 7.6 | 7.5 | 7.7 |
| 30 seconds | 3.9 | 5.9 | 2.9 |
| 1 minute | 2.7 | 4.9 | 2.1 |
| 90 seconds | 2.1 | 3.8 | 1.7 |
| 2 minutes | 1.9 | 3.4 | 1.6 |
| 3 minutes | 1.6 | 2.8 | 1.4 |
| 5 minutes | 1.3 | 2.1 | 1.2 |
| 8 minutes | 1.3 | 1.7 | 1.2 |
| 10 minutes | 1.1 | 1.5 | 1.1 |

The initial water hardness in the wash solution is 12 grains/gallon of calcium and magnesium ions in a 2:1 ratio. The temperature throughout the test is maintained at 100° F. The calcium depletion rates are determined by atomic absorption spectrophotometry as is previously described. The results show that the calcium carbonate-containing granules prepared by the present invention have an effective calcium carbonate surface and substantially equivalent to the non-dried calcium carbonate particles in the slurry.

EXAMPLE VIII

Spray-dried calcium carbonate-containing granules are prepared by forming a slurry of calcium carbonate calcite particles having a mean diameter of about 0.95 micron and thoroughly mixing therewith sodium bicarbonate in a weight ratio of sodium bicarbonate to the calcium carbonate of 1:2. The combined slurry which is about 80% by weight water at 115° F is then pumped to a standard spray-drying unit and contacted with the drying gas which is introduced at about 500° F.

The calcium carbonate particle within the granule so formed retains substantially the same effective surface area and mean particle diameter as the calcium carbonate particles in the slurry. The granule itself is highly puffed or porous allowing for rapid dissolution in the wash water. The puffed granule reduces plant dust problems significantly while segregating and caking are markedly retarded when compared to admixing dry calcium carbonate particles.

Similar results to those obtained above are enjoyed when the mean diameter of the calcium carbonate particles in the slurry are 0.50 micron, 0.25 micron, and 0.10 micron.

EXAMPLE IX

Spray-dried calcium carbonate-containing granules are prepared by forming a slurry of calcium carbonate calcite particles having a mean diameter of about 0.01 micron and thoroughly mixing therewith sodium carbonate in a weight ratio of sodium carbonate to the calcium carbonate of 50:1. The combined slurry which is about 90% by weight water at 100° F is pumped to a standard spray-drying unit and contacted with the drying gas which is introduced at about 800° F.

The calcium carbonate particle within the granule so formed retains substantially the same effective surface area and mean particle diameter as the calcium carbonate particles in the slurry. The granule itself is highly puffed or porous allowing for rapid dissolution in the wash water. The puffed granule reduces plant dust problems significantly while segregation and caking are markedly retarded when compared to admixing dry calcium carbonate particles.

Substantially similar results as those above are obtained when sodium bicarbonate in a weight ratio to the calcium carbonate of 75:1 is substituted for the sodium carbonate.

In this example the calcium carbonate containing granule is spray dried contemporaneously with a detergent base granule in the apparatus described in U.S. Pat. No. 3,629,951, issued to Davis et al., which has been previously incorporated by reference. In this variation of the Davis process the calcium carbonate-containing slurry is sprayed through the atomizing nozzle labeled 20 in FIG. 1 of the Davis et al. patent, while the detergent base granule is introduced through the atomizing nozzles 16 and 18. The detergent slurry introduced in this process, when dried, comprises 20 parts of sodium dodecylalkylbenzene sulfonate, 20 parts sodium sulfate, and 10 parts sodium silicate. Other detergents may be employed in the present example such as sodium alkyl ether sulfate salts or sodium alkyl sulfate salts, as well as other detergent components.

EXAMPLE X

Spray-dried calcium carbonate-containing granules are prepared by forming a slurry of calcium carbonate calcite particles having a mean diameter of about 0.03 micron and thoroughly mixing therewith sodium sesquicarbonate in a weight ratio of sodium sesquicarbonate to the calcium carbonate of 10:1. The combined slurry which is about 95% by weight water at 150° F is then pumped to a standard spray-drying unit and contacted with the drying gas which is introduced at about 575° F.

The calcium cabonate particle within the granule so formed retains substantially the same effective surface area and mean particle diameter as the calcium carbonate particles in the slurry. The granule itself is highly puffed or porous allowing for rapid dissolution in the wash water. The puffed granule reduces plant dust problems significantly while segregation and lumping are markedly retarded when compared to admixing dry calcium carbonate particles.

Equivalent results to those obtained above are enjoyed when the water-soluble salt is sodium carbonate in a weight ratio to the calcium carbonate of 8:1.

What is claimed is:

1. A process for the preparation of a calcium carbonate-containing granule wherein the calcium carbonate has a high effective surface area and a low degree of agglomeration, consisting essentially of the steps of:

a. mixing a member selected from the group consisting of water-soluble alkali metal carbonates, bicarbonates, and sesquicarbonates and mixtures thereof, water, and submicron calcium carbonate particles wherein the weight ratio of the alkali metal salt to the calcium carbonate is from about 1:2 to about 75:1 to form an aqueous slurry, said slurry being substantially free of the watersoluble salts of silicates, phosphates and anionic surfactants; and, b. spray drying the slurry of step (a) to form the calcium carbonate-containing granule.

2. The process of claim 1 wherein the mean diameter of the submircon calcium carbonate particles is from about 0.01 to about 0.5 micron.

3. The process of claim 2 wherein the weight ratio of the alkali metal salt to the calcium carbonate is from about 1:1 to about 50:1.

4. The process of claim 3 wherein the slurry contains from about 20% to about 95% by weight water.

5. The process of claim 3 wherein the weight ratio of the alkali metal salt to the calcium carbonate is from about 3:2 to about 20:1.

6. The process of claim 5 wherein the mean diameter of the submicron calcium carbonate particles is from about 0.01 to about 0.10 micron.

7. The process of claim 6 wherein the alkali metal salt is sodium carbonate.

8. The process of claim 7 wherein the aqueous slurry contains from about 30% to about 90% by weight water.

9. A process for the preparation of a calcium carbonate-containing granule wherein the calcium carbonate particles have a high effective surface area and a low degree of agglomeration, consisting essentially of the steps of:

a. mixing sodium carbonate, water, and calcium carbonate particles having a mean particle diameter of from about 0.01 to about 0.25 micron to form an aqueous slurry having a temperature of from about 50° F to about 250° F and having a water content of from about 30% to about 90% by weight, wherein the weight ratio of the sodium carbonate to the calcium carbonate is from about 1:1 to about 50:1, said slurry being substantially free of the water-soluble salts of silicates, phosphates and anoinic surfactant; and, b. spray drying the slurry of step (a) to form a calcium carbonate-containing granule.

10. The process of claim 9 wherein the mean diameter of the calcium carbonate particles is from about 0.01 to about 0.10 micron.

11. The process of claim 10 wherein the weight ratio of sodium carbonate to the calcium carbonate is from about 2:1 to about 10:1.

12. The process of claim 11 wherein the aqueous slurry is from about 40% to about 80% by weight water.

13. The process of claim 12 wherein the slurry temperature is between about 90° F and about 120° F.

14. The process of claim 3 wherein the calcium carbonate-containing granule is formed concurrently with a detergent granule in a multi-level spray drying operation.

* * * * *